United States Patent [19]

Beikuefner et al.

[11] Patent Number: 4,733,408

[45] Date of Patent: Mar. 22, 1988

[54] SWITCH MECHANISM FOR AN IMAGE INTENSIFIER HOOD IN AN X-RAY DIAGNOSTICS SYSTEM

[75] Inventors: Georg Beikuefner, Roethenbach; Arthur Gall, Langensendelbach; Adelbert Kupfer, Poxdorf, all of Fed. Rep. of Germany

[73] Assignee: Siemens Aktiengesellschaft, Berlin and Munich, Fed. Rep. of Germany

[21] Appl. No.: 914,234

[22] Filed: Oct. 2, 1986

[30] Foreign Application Priority Data

Nov. 15, 1985 [DE] Fed. Rep. of Germany ... 8532381[u]

[51] Int. Cl.[4] ..... H05G 1/54

[52] U.S. Cl. ..... 378/117; 378/114; 378/95; 200/153 T; 200/332

[58] Field of Search ..... 378/117, 114, 91, 95; 200/6.41, 153 T, 153 A, 331, 332, 337

[56] References Cited

U.S. PATENT DOCUMENTS

| | | | |
|---|---|---|---|
| 2,526,390 | 10/1950 | Moran et al. . | |
| 3,493,745 | 2/1970 | Patser et al. | 378/91 |
| 3,588,511 | 6/1971 | Montagne | 378/117 |
| 3,822,875 | 7/1974 | Schmedemann | 378/91 |
| 3,934,147 | 1/1976 | Platz et al. | 378/95 |
| 4,127,775 | 11/1978 | Ohlson | 378/91 |

FOREIGN PATENT DOCUMENTS

| | | |
|---|---|---|
| 967931 | 12/1957 | Fed. Rep. of Germany . |
| 2356276 | 7/1974 | Fed. Rep. of Germany . |
| 2430210 | 1/1976 | Fed. Rep. of Germany . |
| 3343924 | 6/1985 | Fed. Rep. of Germany . |
| 2085627 | 4/1982 | United Kingdom . |

*Primary Examiner*—Janice A. Howell
*Assistant Examiner*—David P. Poita
*Attorney, Agent, or Firm*—Hill, Van Santen, Steadman & Simpson

[57] ABSTRACT

A switch mechanism for an image intensifier hood in an x-ray diagnostics system is connected to a motor for moving the x-ray image intensifier toward and away from an examination subject. If the hood inadvertently comes into contact with the examination subject or a technician, the hood is displaced thereby actuating the switch mechanism and disengaging the motor to stop movement of the x-ray image intensifier, thereby avoiding injury to the examination subject and technician and avoiding damage to the x-ray image intensifier. The switch mechanism is constructed such that actuation thereof occurs upon the presence of forces acting on the hood in the direction of the luminescent screen surface or a direction perpendicular thereto, and each intermediate direction. The hood is provided with a number of such switch mechanisms, each switch mechanism including a lever having one end for actuating an electronic switch, and an opposite end disposed at an obtuse angle with respect to the other end which presses against a beveled cam on the inside surface of the hood, which displaces the lever upon the occurrence of pressure against the hood. The hood and switch mechanisms are attached to the front of the x-ray image intensifier by a ring, and the lever for each switch mechanism is pivotably mounted for movement around an axis extending parallel to a tangent of this ring.

3 Claims, 4 Drawing Figures

SWITCH MECHANISM FOR AN IMAGE INTENSIFIER HOOD IN AN X-RAY DIAGNOSTICS SYSTEM

BACKGROUND OF THE INVENTION

1. Field of the Invention

The present invention relates to an x-ray image intensifier for use in an x-ray diagnostics installation, and in particular to a switch mechanism for a hood for such an image intensifier connected to a motor for moving the image intensifier, which disengages the motor automatically upon dislodgement of the hood.

2. Description of the Prior Art

A switch mechanism for the hood of an x-ray image intensifier is described in German OS No. 33 43 924 which permits the hood to be resiliently mounted on all sides of the housing of the x-ray image intensifier in front of the input luminescent screen coaxially relative to the image intensifier. The hood engages a plurality or switch mechanisms, which are electrically connected to the motor for moving the image intensifier, such that actuation of one or more switches occurs given forces acting on the hood in the direction of the luminescent screen surface as well as the direction perpendicular thereto and each intermediate direction. The hood is mounted on a ring attached to the x-ray image intensifier housing with a plurality of switch mechanisms disposed offset relative to each other each having an actuation element resiliently pressed against an inside wall of the hood. Each actuator is connected to the ring so as to be pivotable around an axis proceeding substantially perpendicular to tne input luminescent screen and an axis proceeding radially relative to the input luminescent screen. Each switch mechanism thus includes two switches having actuation directions coinciding with these axes, or parallel thereto. The structure of each switch mechanism is thus rather complicated.

SUMMARY OF THE INVENTION

It is an object or the present invention to provide a switch mechanism for the hood of an x-ray image intensifier having a simplified structure.

The above object is achieved in accordance with the principles of the present invention wherein each switch mechanism has at least one lever or actuator pivotable around an axis which is tangent to the ring on which the switch mechanisms are mounted, or parallel to such a tangent. One end of this lever actuates an electronic switch, such as a microswitch, and its opposite end is disposed at an obtuse angle relative to the switch-actuating end. This opposite end rests against a beleved cam at the inside surface of the hood and is thus moved given pressure against the hood. The actuation lever of each switch mechanism is thus pivotable only around a single axis. The actuators reliably pivot for disconnecting the drive motor for the x-ray image intensifier upon the occurrence of a force pressing against the exterior of the hood in a full range of directions.

The hood may be centrally held by resilient wires extending in a longitudinal direction which also proceed parallel to a tangent to the ring, and are secured to the ring. When striking against an obstacle, the hood will be deflected from its normal position, and return to this position as a consequence of the resiliently mounted wires. A particularly simply fastening of the ring to the housing of the x-ray image intensifier is possibie in an embodiment wherein the ring has a tightening strap which presses detents carried on the ring against the outside of the x-ray image intensifier housing.

DESCRIPTION OF THE PREFERRED EMBODIMENTS

Figure 1:
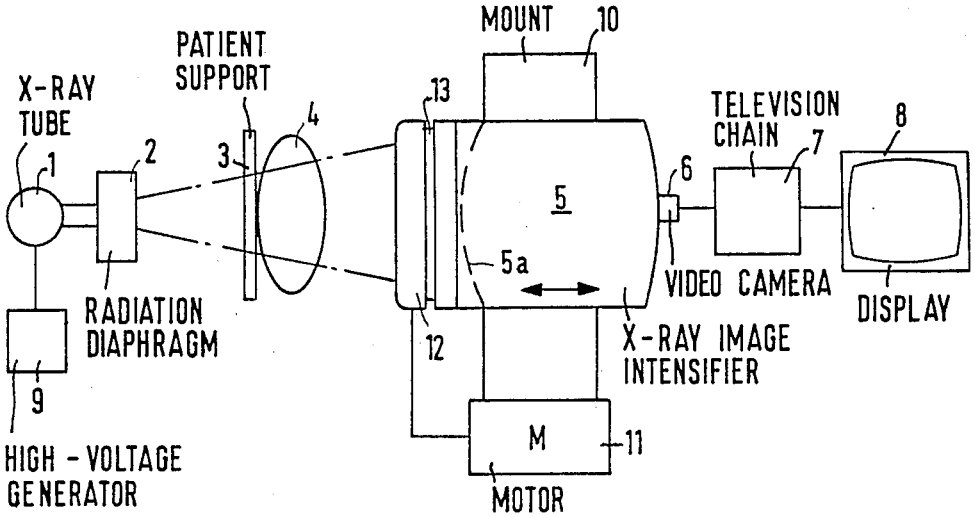
FIG. 1 is a schematic block diagram of an x-ray diagnostics installation having an x-ray image intensitier with a hood in which a switch mechanism constructed in accordance with the principles of the present invention can be employed.

A conventional x-ray diagnostics system of the type in which the switch mechanism described below may be employed is schematically shown in FIG. 1. The system includes an x-ray tube 1 supplied by a high-voltage generator 9 for generating an x-ray beam through a radiation diaphragm 2. The beam propagates through a patient 4 supported on a patient support 3 and is incident on the input luminescent screen 5*a* of an x-ray image intensifier 5. The output images from the intensifier 5 are picked up by a video camera 6 and are displayed on a monitor 8 via a television chain 7.

The x-ray image intensifier 5 is seated in a mount 10 which is adjustable relative to the patient support 3 by a motor 11. A hood 12 is resiliently mounted on the housing of the x-ray image intensifier 5 in front or the luminescent screen 5*a* and arranged coaxially relative to the x-ray image intensifier 5. The hood 12, when dislodged by bumping, acts on a plurality of switch mechanisms described in detail below which are actuated upon the occurrence of forces on the hood 12 in the direction of the luminescent screen surface as well as the direction perpendicular thereto, and all intermediate directions. The switches are connected by a line to the motor 11 so that if, for example, the hood 12 comes into contact with the patient 4 or the patient support 3 during movement thereof by the motor 11, the motor 11 is automatically de-energized.

Figure 2:
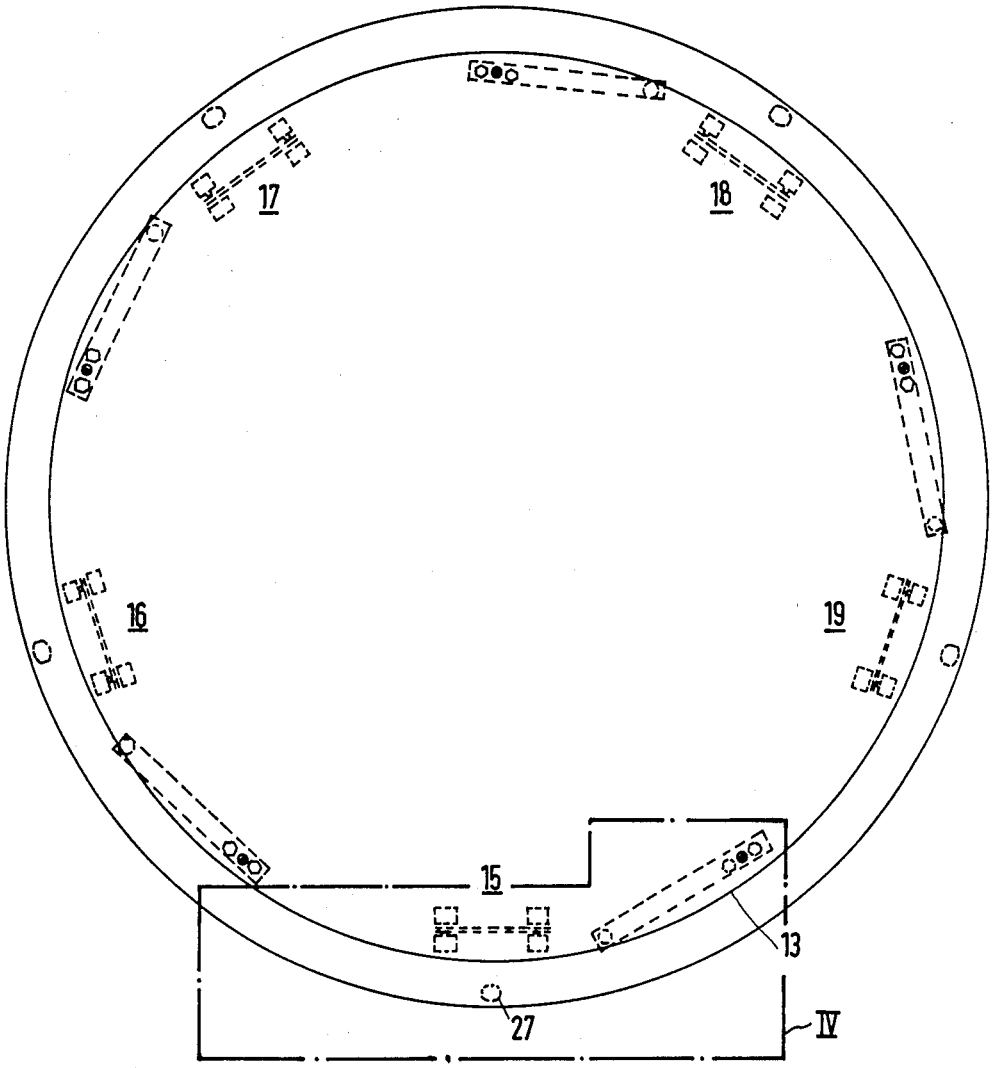
FIG. 2 is a front elevational view of a mounting ring attachable to the housing of the x-ray image intensifier shown in FIG. 1 showing the location of a plurality of switch mechanisms constructed in accordance with principles of the present invention.
Figure 3:
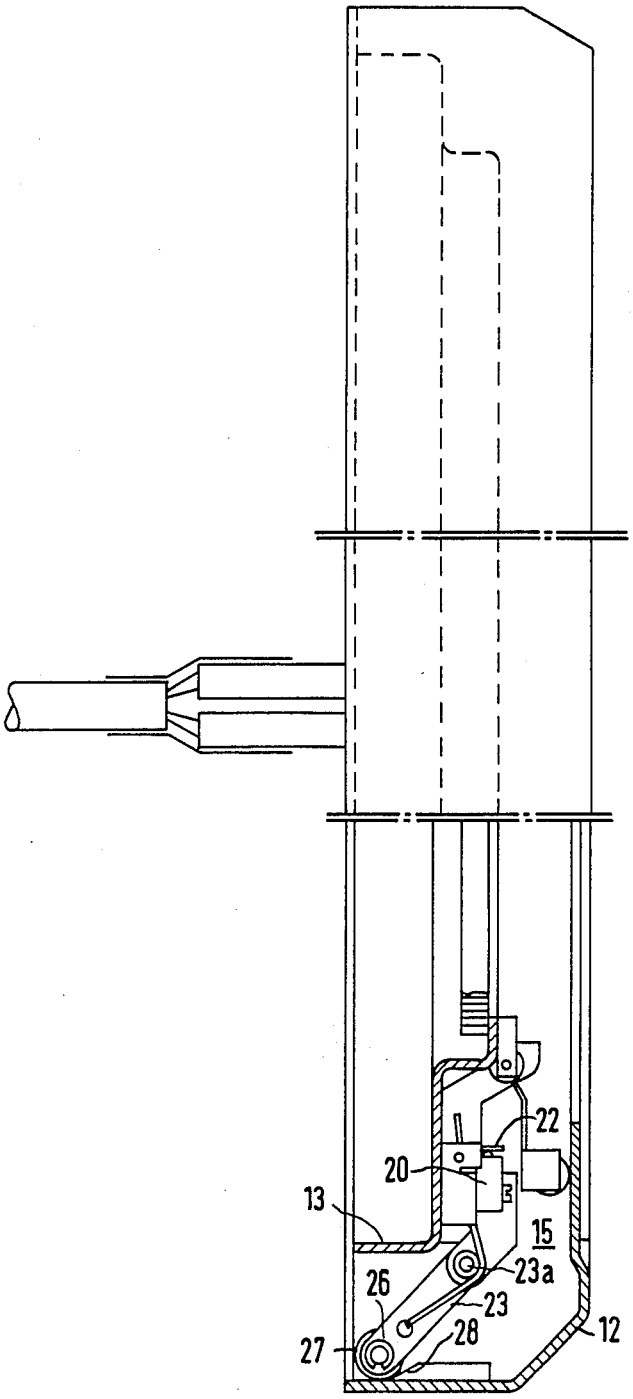
FIG. 3 is a side view, partly in section, of the hood for the x-ray image intensitier with one of the switch mechanisms constructed in accordance with the principles of the present invention.
Figure 4:
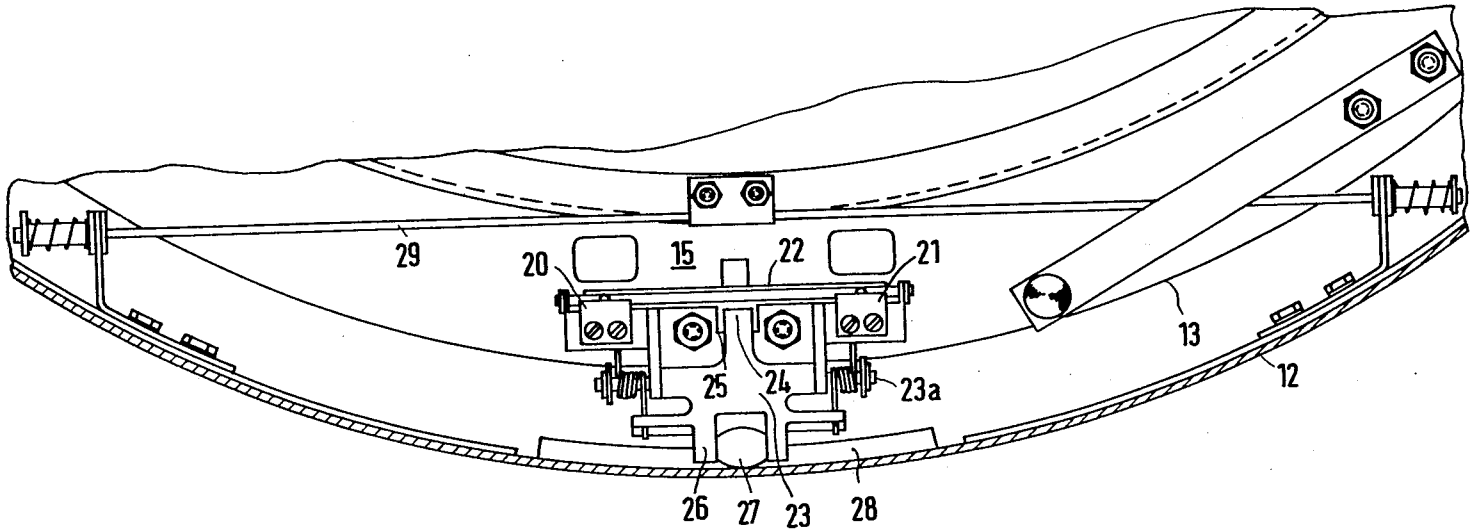
FIG. 4 is an enlarged view of the portion designated IV in FIG. 2 showing a front elevation detail of a switch mechanism constructed in accordance with the principles of the present invention.

As shown in FIGS. 2 through 4, the hood 12 surrounds a ring 13 (also visible in FIG. 1) which is secured to the x-ray image intensifier housing. The ring 13 can be screwed to the housing or can be clamped thereto by a tightening strag having detents pressed against the outside of the housing. The ring 13 may carry, for example, five switch mechanisms 15, 16, 17, 18 and 19 disposed around the ring at approximately 72° relative to each other. All of the switch mechanisms are identically constructed, with the structural details of the switch mechanism 15 being shown in FIGS. 3 and 4.

As shown in FIGS. 3 and 4, the switch mechanism 15 has two microswitches 20 and 21 attached to the ring 13 which can be actuated by an angled plate 22. The plate 22 is in turn actuatable by a lever 23 which is mounted for pivotable movement around an axis 23*a* extending parallel to a tangent to the ring 13. One end 24 of the lever 23 presses from above against a recess 25 in the plate 22. Normally, the plate 22 presses against the actuation elements of the switches 20 and 21 so as to depress those elements. An opposite end 26 of the lever 23 has a roller 27 which is resilently presses against the inside of the hood 12 against a beveled cam 28.

When a force proceeding perpendicular to the radiation entry face acts on the hood 12, the cam 28 moved the lever 23 somewhat in a clockwise direction so that, via the plate 22, the actuation members of the switches 20 and 21 are released, causing the drive motor 11 to be de-energized.

If a force acts on the hood 12 obliquely relative to the radiation entry face, the lever 23 via the roller 27 is similarly pivoted in the described direction and the operation of the motor 11 is again interrupted.

As can be seen from FIGS. 3 and 4, reliable switch actuation occurs given forces acting on the hood 12 within a substantially hemispherical range of about 180°.

As can be seen in FIG. 3, the ends 24 and 26 of the lever 23 are disposed at an obtuse angle so that the above-described reliable switch actuation occurs.

As can be seen in FIG. 4, the hood 12 is centrally held by a plurality of wires, such as the wire reference 29, extending longitudinally and resiliently seated. The wires 29 proceed parallel to a tangent to the ring 13, i.e., are a cord thereof, and are secured thereto.

Although modifications and changes may be suggested by those skilled in the art it is the intention of the inventors to embody within the patent warranted hereon all changes and modifications as reasonably and properly come within the scope of their contribution to the art.

We claim as our invention:

1. In an x-ray diagnostics installation having an x-ray image intensifier with a hood surrounding the input luminescent screen thereof, a plurality of switch mechanisms or resiliently mounting said hood on a mounting ring attached to the housing of said x-ray image intensifier, said x-ray image intensifier being displaceable by a motor and said switch mechanisms being electrically connected to said motor for de-energizing said motor upon dislodgement of said hood, each switch mechanism comprising:

at least one electrical switch connected for de-energizing said motor upon a change in state of said switch;

a lever having a first end disposed for actuating said electrical switch for causing a change of state thereof and having an opposite second end disposed at an obtuse angle with respect to said first end;

means for mounting said lever for pivotable movement around an axis parallel to a tangent of said ring; and a beveled cam carried on an inside surface of said hood and pressing against said second end of said lever for pivoting said lever upon dislodgement of said hood and thereby causing a change of state of said electrical switch to de-energize said motor.

2. An x-ray diagnostics installation as claimed in claim 1, further comprising a tightenable strap attached to said ring for fastening said ring to said image intensifier housing.

3. An x-ray diagnostics installation as claimed in claim 1, further comprising a plurality of resiliently mounted wires attached to said ring and to said hood for supporting said hood, said wires extending longitudinally parallel to a tangent to said ring.

* * * * *